US008878086B2

(12) United States Patent
Chen

(10) Patent No.: US 8,878,086 B2
(45) Date of Patent: Nov. 4, 2014

(54) LUMINOUS KEYBOARD

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 291 days.

(21) Appl. No.: 13/416,868

(22) Filed: Mar. 9, 2012

(65) Prior Publication Data

US 2013/0134021 A1 May 30, 2013

(30) Foreign Application Priority Data

Nov. 25, 2011 (TW) ..... 100143439 A

(51) Int. Cl.
*H01H 9/00* (2006.01)

(52) U.S. Cl.
USPC ..... 200/310; 200/314

(58) Field of Classification Search
USPC ..... 200/310, 311
See application file for complete search history.

(56) References Cited

U.S. PATENT DOCUMENTS

| | | | | |
|---|---|---|---|---|
| 6,861,600 | B1 * | 3/2005 | Schulz et al. | 200/310 |
| 7,709,760 | B2 * | 5/2010 | Chen et al. | 200/314 |
| 7,952,043 | B2 * | 5/2011 | Lin | 200/310 |
| 8,337,028 | B2 * | 12/2012 | Tatehata et al. | 362/23.03 |
| 8,530,768 | B2 * | 9/2013 | Hwa | 200/310 |
| 2012/0008211 | A1 * | 1/2012 | Chiang | 359/599 |
| 2013/0286631 | A1 * | 10/2013 | Chen | 362/23.03 |

* cited by examiner

*Primary Examiner* — Renee Luebke
*Assistant Examiner* — Ahmed Saeed
(74) *Attorney, Agent, or Firm* — Kirton McConkie; Evan R. Witt

(57) ABSTRACT

A luminous keyboard includes a light-emitting element, a membrane circuit member, a key base plate, and plural keys. The membrane circuit member includes an upper wiring board and a lower wiring board. A first circuit pattern is formed on the lower wiring board. A second circuit pattern is formed on the upper wiring board. The first circuit pattern and the second circuit pattern collectively define plural membrane switches. The lower wiring board further includes plural film layers for increasing the light-guiding efficacy of the lower wiring board. Moreover, the plural keys are connected to the key base plate. The key base plate is arranged between the plural keys and the membrane circuit member.

42 Claims, 10 Drawing Sheets

LUMINOUS KEYBOARD

FIELD OF THE INVENTION

The present invention relates to a luminous keyboard, and more particularly to a luminous keyboard with an illuminating function.

BACKGROUND OF THE INVENTION

Recently, with increasing development of information industries, portable information devices such as notebook computers, mobile phones or personal digital assistants are widely used in many instances. In a case that a portable information device is used in a dim environment, the numbers and characters marked on the keys of the keyboard of the portable information device are not clearly visible. In other words, the dim environment becomes hindrance from operating the keyboard. In addition, if the keyboard is used in the dim environment, the user is readily suffered from vision impairment. For solving these drawbacks, a luminous keyboard has been disclosed. The luminous keyboard could be used in the dim environment in order to enhance the applications thereof. Moreover, by changing the arrangement of luminous regions, the information device having the luminous keyboard is more aesthetically-pleasing and thus the competiveness thereof is enhanced.

FIG. 1 is a schematic cross-sectional view illustrating a conventional luminous keyboard. As shown in FIG. 1, the luminous keyboard 1 comprises a reflector 11, a light guide plate 12, a base pate 13, a membrane circuit member 14, plural keys 15, and light-emitting elements 16. The membrane circuit member 14 comprises a lower wiring board 141, an upper wiring board 142, and an intermediate board 143. The intermediate board 143 is arranged between the lower wiring board 141 and the upper wiring board 142. The lower wiring board 141, the intermediate board 143 and the upper wiring board 142 are made of a transparent light-guiding material. The transparent light-guiding material includes for example polycarbonate (PC) or polyethylene terephthalate (PET).

Please refer to FIG. 2, which is a schematic exploded view illustrating a membrane circuit board of the luminous keyboard of FIG. 1. The lower wiring board 141 has a first circuit pattern 1411. The first circuit pattern 1411 comprises plural silver paste conductor lines 14111 and plural lower contacts 14112. The upper wiring board 142 has a second circuit pattern 1421. The second circuit pattern 1421 comprises plural silver paste conductor lines 14211 and plural upper contacts 14212. The intermediate board 143 has plural perforations 1431 corresponding to the plural lower contacts 14112 and the plural upper contacts 14212. Each of the upper contacts 14212 and the corresponding lower contact 14112 are collectively defined as a membrane switch 144.

The key base plate 13 is disposed under the membrane circuit member 14. In addition, the key base plate 13 comprises plural openings 131, a first fixing structure 132, and a second fixing structure 133. Each key 15 comprises a keycap 151, an elastic element 152, and a scissors-type connecting element 153. The keycap 151 comprises a first keycap fixing structure 1511 and a second keycap fixing structure 1512. The scissors-type connecting element 153 comprises a first frame 1531 and a second frame 1532. In addition, the elastic element 152 is arranged between the keycap 151 and the membrane circuit member 14.

The membrane circuit member 14 further comprises apertures 145 and 146 (see FIG. 1). The first fixing structure 132 and the second fixing structure 133 are penetrated through the apertures 145 and 146, respectively. A first end 1531A of the first frame 1531 is connected to the second fixing structure 133, and a second end 1531B of the first frame 1531 is connected to the first keycap fixing structure 1511. In addition, a second end 1532A of the second frame 1532 is connected to the first fixing structure 132, and a second end 1532B of the second frame 1532 is connected to the second keycap fixing structure 1512.

When any key 15 is depressed and moved downwardly relative to the key base plate 13, the first frame 1531 and the second frame 1532 of the scissors-type connecting element 153 are switched from an open-scissors state to a folded state. Moreover, as the keycap 151 is moved downwardly to compress the elastic element 152, the elastic element 152 is sustained against a corresponding upper contact 14212. Consequently, the upper contact 14212 is inserted into a corresponding perforation 1431 to touch the corresponding lower contact 14122. In such way, the corresponding membrane switch 144 is electrically conducted, and the luminous keyboard 1 generates a corresponding key signal. Whereas, when the depressing force exerted on the key 15 is eliminated, an elastic force provided by the elastic element 152 is acted on the keycap 151. Due to the elastic force, the keycap 151 is moved upwardly relative to the key base plate 13. Meanwhile, the first frame 1531 and the second frame 1532 of the scissors-type connecting element 153 are switched from the folded state to the open-scissors state, and the keycap 151 is returned to its original position.

The light-emitting elements 16 are located at bilateral sides of the light guide plate 12 for emitting light beams. The light beams are incident into the light guide plate 12. The light guide plate 12 is disposed on the reflector 11. Plural light-guiding dots 121 are formed on a bottom surface of the light guide plate 12 for collecting and scattering the light beams. The light-guiding dots 121 are aligned with corresponding keys 15. After the light beams are incident into the light guide plate 12, the light beams are diffused into the whole light guide plate 12. Due to the ink property of the light-guiding dots 121, the light beams will be scattered upwardly or downwardly. The portions of the light beams that are scattered upwardly will be sequentially transmitted through the openings 131 of the key base plate 13 and the membrane circuit member 14 and directed to the plural keys 15. The portions of the light beams that are scattered downwardly will be reflected by the reflector 11, and the reflected light beams are also directed upwardly. In such way, the light beams provided by the light-emitting elements 16 can be well utilized to illuminate the plural keys 15. However, the conventional luminous keyboard 1 still has the following drawbacks.

Firstly, although the reflector 11 can facilitate the light beams which are scattered downwardly from the light-guiding dots 121 to be reflected upwardly, since the material of the reflector 11 of the conventional luminous keyboard 1 is light-transmissible, some of the light beams which are scattered downwardly from the light-guiding dots 121 may be transmitted through the reflector 11. Under this circumstance, a portion of the light amount is lost.

Secondly, please also refer to FIG. 3. FIG. 3 schematically illustrates a light path in the lower wiring board of the membrane circuit member of FIG. 2. As shown in FIG. 3, the first circuit pattern 1411 is formed on a top surface of the lower wiring board 141, and comprises plural silver paste conductor lines 14111. Since these silver paste conductor lines 14111 have functions of collecting and scattering the light beams, after the light beams L1 provided by the light-emitting elements 16 are introduced into the lower wiring board 141 through the openings 131 of the key base plate 13, the light beams L2 passing through the silver paste conductor lines 14111 of the first circuit pattern 1411 seem very bright. Since most of the silver paste conductor lines 14111 are not aligned with the keys, the amount of the light beams to be directed to the keys 15 to illuminate the keys 15 are consumed by the silver paste conductor lines 14111. That is, although the light beams L1 should be mostly directed to the keys 15 according to the original design, the silver paste conductor lines 14111 may consume the amount of the light beams L2 because of the characteristics of the silver paste conductor lines 14111. Consequently, only the light beams L3 are retained to be utilized by the luminous keyboard 1. Under this circumstance, the keys 15 of the luminous keyboard 1 fail to be effectively illuminated.

FIG. 4 is a schematic cross-sectional view illustrating another conventional luminous keyboard. Except for the following items, the configurations of the luminous keyboard of FIG. 4 are identical to those of FIG. 1, and are not redundantly described herein. For example, the light-emitting elements 96 are located at bilateral sides of the lower wiring board 941 of the membrane circuit member 94. In addition, the lower wiring board 941 is made of a light-guiding material. Plural light-guiding dots 921 are formed on the lower wiring board 941 for collecting and scattering the light beams. In other words, since the lower wiring board 941 of the membrane circuit member 94 has the light-guiding function, the reflector 11 and the light guide plate 12 used in the conventional luminous keyboard 1 may be omitted. Under this circumstance, the thickness of the luminous keyboard of FIG. 4 is reduced.

However, the conventional luminous keyboard of FIG. 4 still has the above two drawbacks of the conventional luminous keyboard of FIG. 1. In addition, the membrane circuit member 94 further comprises apertures 945 and 946. A first fixing structure 932 and a second fixing structure 933 of the key base plate 93 are penetrated through the apertures 945 and 946, respectively. Consequently, the light-guiding function of the lower wiring board 941 of the membrane circuit member 94 is discontinuous. That is, the light beams from the light-emitting elements 96 fail to be transmitted through the regions of the lower wiring board 941 corresponding to the apertures 945 or 946. Under this circumstance, the illuminating efficacy of the luminous keyboard 9 is impaired.

From the above discussions, the light utilization efficiency of the conventional luminous keyboard 1 or 9 is unsatisfied. Therefore, there is a need of providing a luminous keyboard with enhanced light utilization efficiency.

SUMMARY OF THE INVENTION

The present invention provides a luminous keyboard with enhanced light utilization efficiency.

In accordance with an aspect of the present invention, there is provided a luminous keyboard. The luminous keyboard includes at least one light-emitting element, a membrane circuit member, an upper wiring board, plural keys, and a key base plate. The light-emitting element is used for providing light beams to illuminate the luminous keyboard. The membrane circuit member includes a lower wiring board and an upper wiring board. The lower wiring board includes a first circuit pattern and plural light-guiding dots. The first circuit pattern includes plural lower contacts, and the light beams from the light-emitting element are collected and scattered by the plural light-guiding dots. The lower wiring board further includes a first film layer and a second film layer for increasing an amount of the light beams which are scattered upwardly by the plural light-guiding dots. The upper wiring board includes a second circuit pattern, wherein the second circuit pattern includes plural upper contacts corresponding to the plural lower contacts. In addition, each of the upper contacts and the corresponding lower contact are separated from each other by a spacing interval, and each of the upper contacts and the corresponding lower contact are collectively defined as a membrane switch. The plural keys are aligned with the plural membrane switches for conducting corresponding membrane switches. The key base plate is used for connecting the plural keys. The key base plate has plural openings corresponding to respective keys. The key base plate is arranged between the plural keys and the membrane circuit member.

In an embodiment, each of the first film layer and the second film layer is a light-guiding film layer.

In an embodiment, the plural light-guiding dots are arranged between the first film layer and the second film layer.

In an embodiment, the plural light-guiding dots are formed on one of the first film layer and the second film layer by a screen printing process, a thermal compression process or an injection process.

In an embodiment, the lower wiring board further includes a spacer film layer, which is arranged between the first film layer and the first circuit pattern for increasing possibility of resulting in total internal reflection when the light beams are incident into the first film layer.

In an embodiment, the spacer film layer is formed on the first film layer by a printing process, a film deposition process, a gluing process or a thermal compression process.

In an embodiment, the luminous keyboard further includes a light-transmissible transparent adhesive, which is arranged between the first film layer and the second film layer, so that the first film layer and the second film layer are combined together through the light-transmissible transparent adhesive.

In an embodiment, the light-guiding film layer is made of polyethylene terephthalate (PET), polycarbonate (PC) or polymethylmethacrylate (PMMA).

In an embodiment, the first film layer is a light-guiding film layer, and the second film layer is a spacer film layer. The spacer film layer is arranged between the light-guiding film layer and the first circuit pattern for increasing possibility of resulting in total internal reflection when the light beams are incident into the light-guiding film layer.

In an embodiment, the plural light-guiding dots are formed on a bottom surface of the light-guiding film layer.

In an embodiment, the spacer film layer is formed on the light-guiding film layer by a printing process, a film deposition process, a gluing process or a thermal compression process.

In an embodiment, the light-emitting element is a light emitting diode, which is located beside the membrane circuit member for providing the light beams to the membrane circuit member.

In an embodiment, the luminous keyboard further includes a keyboard base, which is disposed under the membrane circuit member for supporting the plural keys, the key base plate, the membrane circuit member and the light-emitting element.

In an embodiment, each of the plural keys includes a keycap and a connecting element. The keycap is exposed outside the luminous keyboard. The connecting element is arranged between the key base plate and the keycap for connecting the key base plate and the keycap, so that the keycap is movable upwardly or downwardly relative to the key base plate.

In an embodiment, each of the plural keys includes an elastic element. The elastic element is arranged between the keycap and the key base plate, and includes a sustaining part. The connecting element is a scissors-type connecting element. When the keycap is depressed, the elastic element is compressed and the sustaining part is penetrated through a corresponding opening of the key base plate to push against a corresponding membrane switch. When a depressing force exerted on the keycap is eliminated, an elastic force provided by the elastic element is acted on the keycap, so that the keycap is returned to an original position.

In an embodiment, the membrane circuit member further includes an intermediate board, which is arranged between the upper wiring board and the lower wiring board, so that each of the upper contacts and the corresponding lower contact are separated from each other by the spacing interval. The intermediate board has plural perforations corresponding to the plural lower contacts and the plural upper contacts.

In accordance with another aspect of the present invention, there is provided a luminous keyboard. The luminous keyboard includes at least one light-emitting element, a membrane circuit member, plural keys, and a key base plate. The light-emitting element is used for providing light beams to illuminate the luminous keyboard. The membrane circuit member includes a circuit pattern and plural light-guiding dots. The circuit pattern includes plural membrane switches, and the light beams from the light-emitting element are collected and scattered by the plural light-guiding dots. The membrane circuit member further includes a first film layer and a second film layer for increasing an amount of the light beams which are scattered upwardly by the plural light-guiding dots. The plural keys are aligned with the plural membrane switches for conducting corresponding membrane switches. The key base plate is used for connecting the plural keys. The key base plate has plural openings corresponding to respective keys. The key base plate is arranged between the plural keys and the membrane circuit member.

In an embodiment, each of the membrane switches includes a first conductive part and a second conductive part, wherein the first conductive part is separated from the second conductive part.

In an embodiment, each of the plural keys includes a keycap and a connecting element. The keycap is exposed outside the luminous keyboard. The connecting element is arranged between the key base plate and the keycap for connecting the key base plate and the keycap, so that the keycap is movable upwardly or downwardly relative to the key base plate. The key conductor is arranged between the keycap and the key base plate. When the keycap is depressed, the key conductor is penetrated through a corresponding opening of the key base plate to push against a corresponding membrane switch, so that the corresponding membrane switch is conducted.

In an embodiment, the connecting element is a scissors-type connecting element.

In an embodiment, each of the first film layer and the second film layer is a light-guiding film layer.

In an embodiment, the plural light-guiding dots are arranged between the first film layer and the second film layer.

In an embodiment, the plural light-guiding dots are formed on one of the first film layer and the second film layer by a screen printing process, a thermal compression process or an injection process.

In an embodiment, the lower wiring board further includes a spacer film layer, which is arranged between the first film layer and the circuit pattern for increasing possibility of resulting in total internal reflection when the light beams are incident into the first film layer.

In an embodiment, the spacer film layer is formed on the first film layer by a printing process, a film deposition process, a gluing process or a thermal compression process.

In an embodiment, the luminous keyboard further includes a light-transmissible transparent adhesive, which is arranged between the first film layer and the second film layer, so that the first film layer and the second film layer are combined together through the light-transmissible transparent adhesive.

In an embodiment, the light-guiding film layer is made of polyethylene terephthalate (PET), polycarbonate (PC) or polymethylmethacrylate (PMMA).

In an embodiment, the first film layer is a light-guiding film layer, and the second film layer is a spacer film layer. The spacer film layer is arranged between the light-guiding film layer and the circuit pattern for increasing possibility of resulting in total internal reflection when the light beams are incident into the light-guiding film layer.

In an embodiment, the plural light-guiding dots are formed on a bottom surface of the light-guiding film layer.

In an embodiment, the spacer film layer is formed on the light-guiding film layer by a printing process, a film deposition process, a gluing process or a thermal compression process.

In an embodiment, the light-emitting element is a light emitting diode, which is located beside the membrane circuit member for providing the light beams to the membrane circuit member.

In an embodiment, the luminous keyboard further includes a keyboard base, which is disposed under the membrane circuit member for supporting the plural keys, the key base plate, the membrane circuit member and the light-emitting element.

In accordance with a further aspect of the present invention, there is provided a luminous keyboard. The luminous keyboard includes at least one light-emitting element, a membrane circuit member, plural keys, and a key base plate. The light-emitting element is used for providing light beams to illuminate the luminous keyboard. The membrane circuit member includes an upper wiring board and a lower wiring board. The upper wiring board includes an upper film layer and a second circuit pattern formed on a bottom surface of the upper film layer, wherein the second circuit pattern has plural upper contacts. The lower wiring board includes a first film layer, a first circuit pattern, and a second film layer arranged between the first film layer and the first circuit pattern. The first circuit pattern includes plural lower contacts corresponding to the plural upper contacts. Each of the upper contacts and the corresponding lower contact are separated from each other by a spacing interval. Each of the upper contacts and the corresponding lower contact are collectively defined as a membrane switch, wherein a refractive index of the second film layer is lower than a refractive index of the first film layer. The plural keys are aligned with the plural membrane switches for conducting corresponding membrane switches. The key base plate is used for connecting the plural keys. The key base plate has plural openings corresponding to respective keys. The key base plate is arranged between the plural keys and the membrane circuit member.

In an embodiment, the first circuit pattern further includes plural metallic conductor lines.

In an embodiment, the metallic conductor lines are silver paste conductor lines.

In an embodiment, the second film layer is a single continuous film layer, and the metallic conductor lines are formed on the single continuous film layer.

In an embodiment, the second film layer is formed on the first film layer by a printing process, a film deposition process, a gluing process or a thermal compression process.

In an embodiment, the second film layer includes plural separate block-type film layers, and the plural metallic conductor lines are formed on the plural block-type film layers.

In an embodiment, the plural block-type film layers are formed on the first film layer by a printing process, a film deposition process, a gluing process or a thermal compression process.

In an embodiment, the first film layer is a light-guiding film layer.

In an embodiment, the light-guiding film layer is made of polyethylene terephthalate (PET), polycarbonate (PC) or polymethylmethacrylate (PMMA).

In an embodiment, the light-emitting element is a light emitting diode, which is located beside the membrane circuit member for providing the light beams to the membrane circuit member.

In an embodiment, the luminous keyboard further includes a keyboard base, which is disposed under the membrane circuit member for supporting the plural keys, the key base plate, the membrane circuit member and the light-emitting element.

In an embodiment, each of the plural keys includes a keycap and a connecting element. The keycap is exposed outside the luminous keyboard. The connecting element is arranged between the key base plate and the keycap for connecting the key base plate and the keycap, so that the keycap is movable upwardly or downwardly relative to the key base plate.

In an embodiment, each of the plural keys includes an elastic element. The elastic element is arranged between the keycap and the key base plate, and includes a sustaining part. The connecting element is a scissors-type connecting element. When the keycap is depressed, the elastic element is compressed and the sustaining part is penetrated through a corresponding opening of the key base plate to push against a corresponding membrane switch. When a depressing force exerted on the keycap is eliminated, an elastic force provided by the elastic element is acted on the keycap, so that the keycap is returned to an original position.

In an embodiment, the membrane circuit member further includes an intermediate board, which is arranged between the upper wiring board and the lower wiring board, so that each of the upper contacts and the corresponding lower contact are separated from each other by the spacing interval. The intermediate board has plural perforations corresponding to the plural lower contacts and the plural upper contacts.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
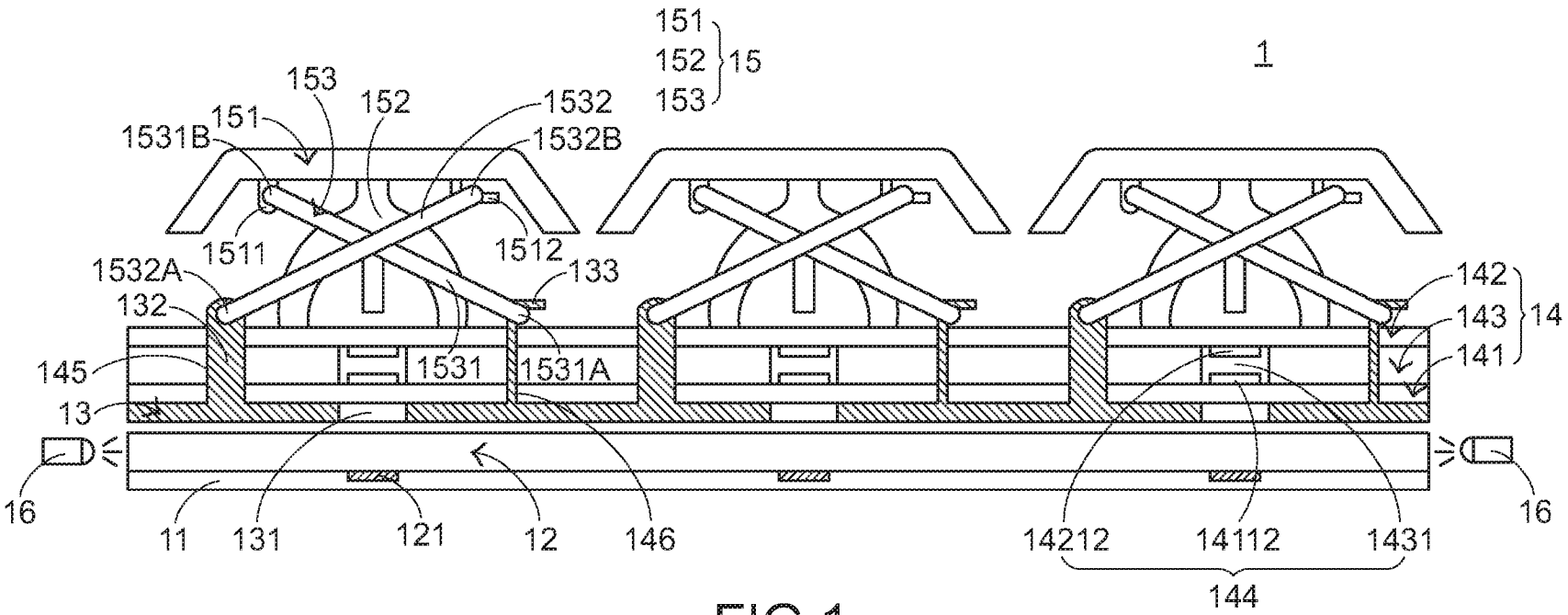
FIG. 1 PRIOR ART
FIG. 1 is a schematic cross-sectional view illustrating a conventional luminous keyboard.
Figure 2:
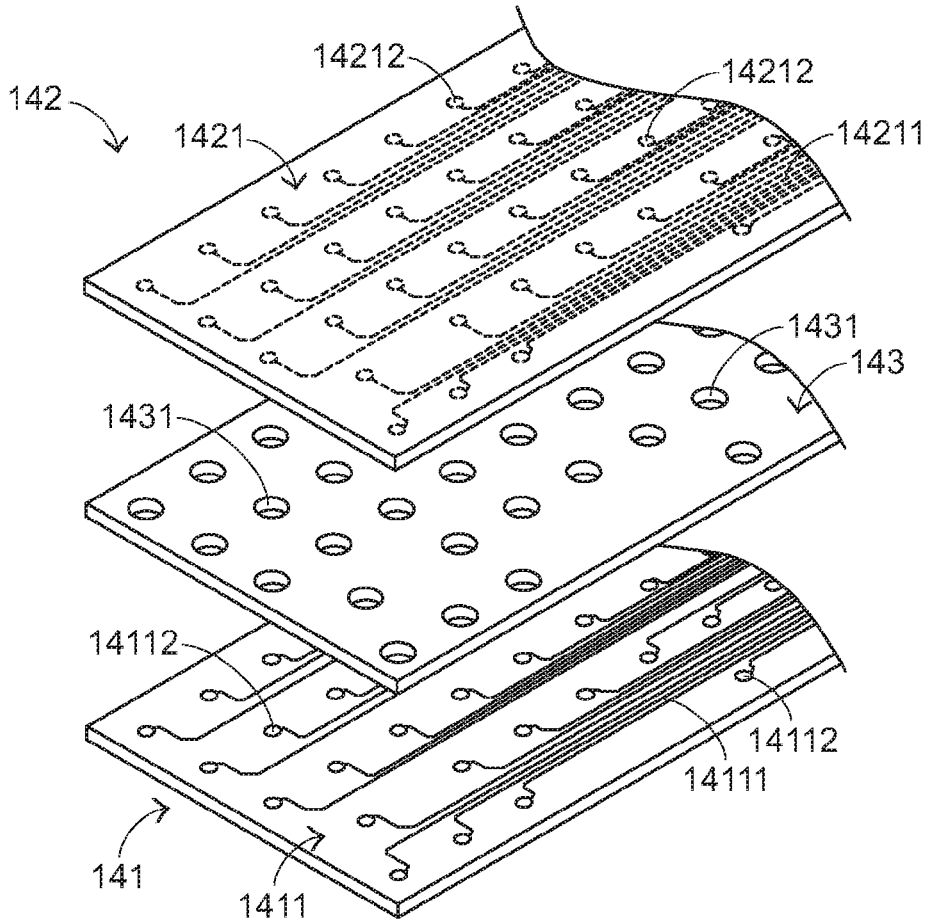
FIG.2 PRIOR ART
FIG. 2 is a schematic exploded view illustrating a membrane circuit board of the luminous keyboard of FIG. 1.
Figure 3:
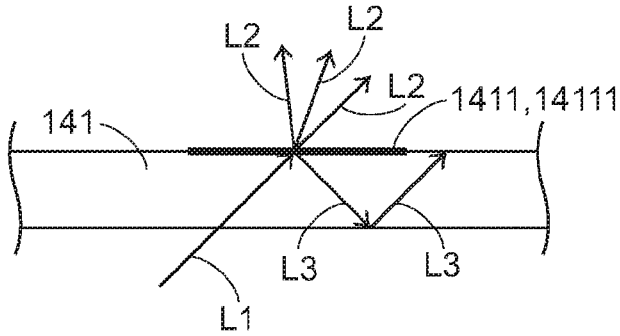
FIG.3 PRIOR ART
FIG. 3 schematically illustrates a light path in the lower wiring board of the membrane circuit member of FIG. 2.
Figure 4:
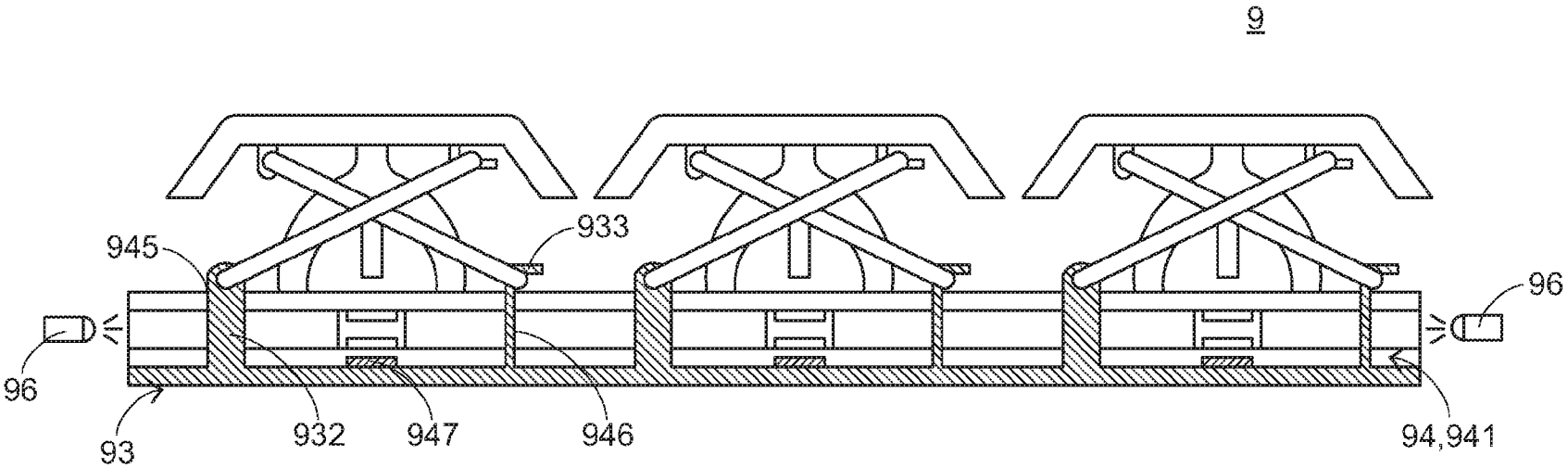
FIG.4 PRIOR ART
FIG. 4 is a schematic cross-sectional view illustrating another conventional luminous keyboard.
Figure 5:
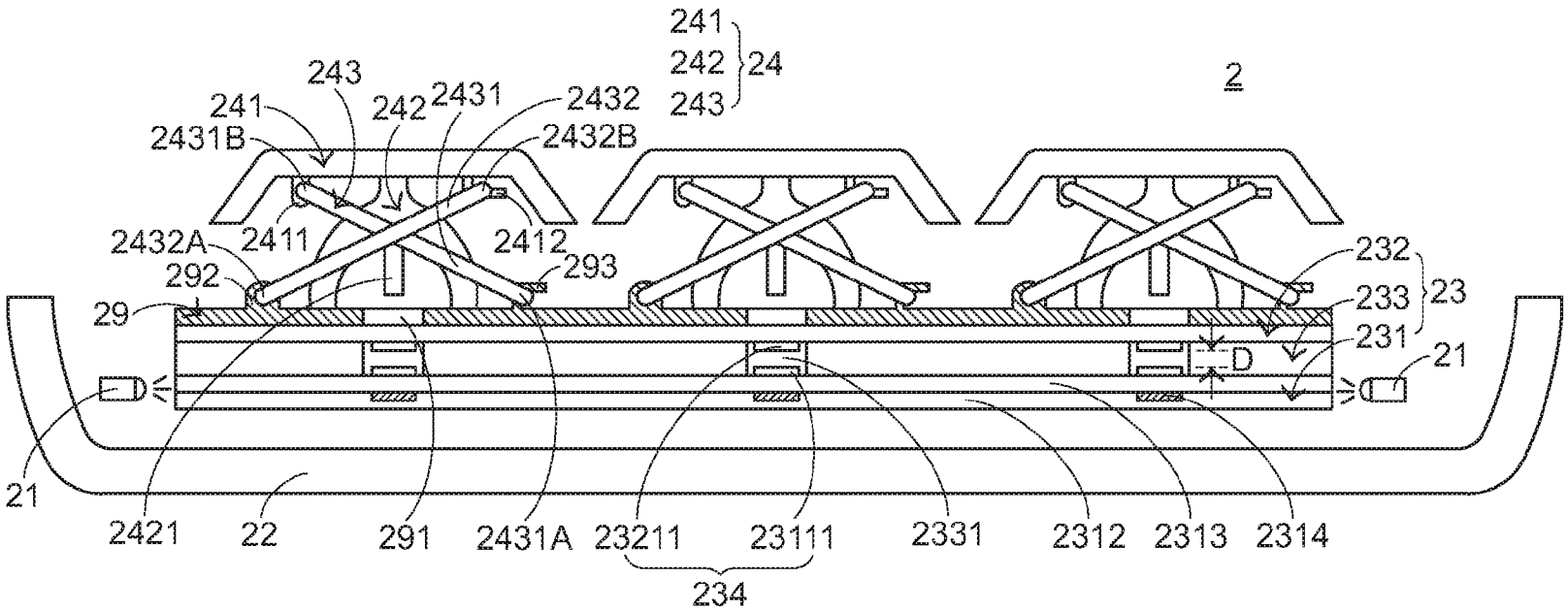
FIG. 5 is a schematic cross-sectional view illustrating a luminous keyboard according to a first embodiment of the present invention.

FIG. 5 is a schematic cross-sectional view illustrating a luminous keyboard according to a first embodiment of the present invention. From bottom to top, a keyboard base 22, a membrane circuit member 23, a key base plate 29 and plural keys 24 of the luminous keyboard 2 are sequentially shown. The luminous keyboard 2 further comprises a light-emitting element 21. The light-emitting element 21 is located at a lateral side of the membrane circuit member 23 for emitting light beams. The light beams are incident into the membrane circuit member 23. In this embodiment, the light-emitting element 21 is a light emitting diode. Moreover, the keyboard base 22 is used for supporting the membrane circuit member 23, the key base plate 29, the plural keys 24 and the light-emitting element 21.

Figure 6:
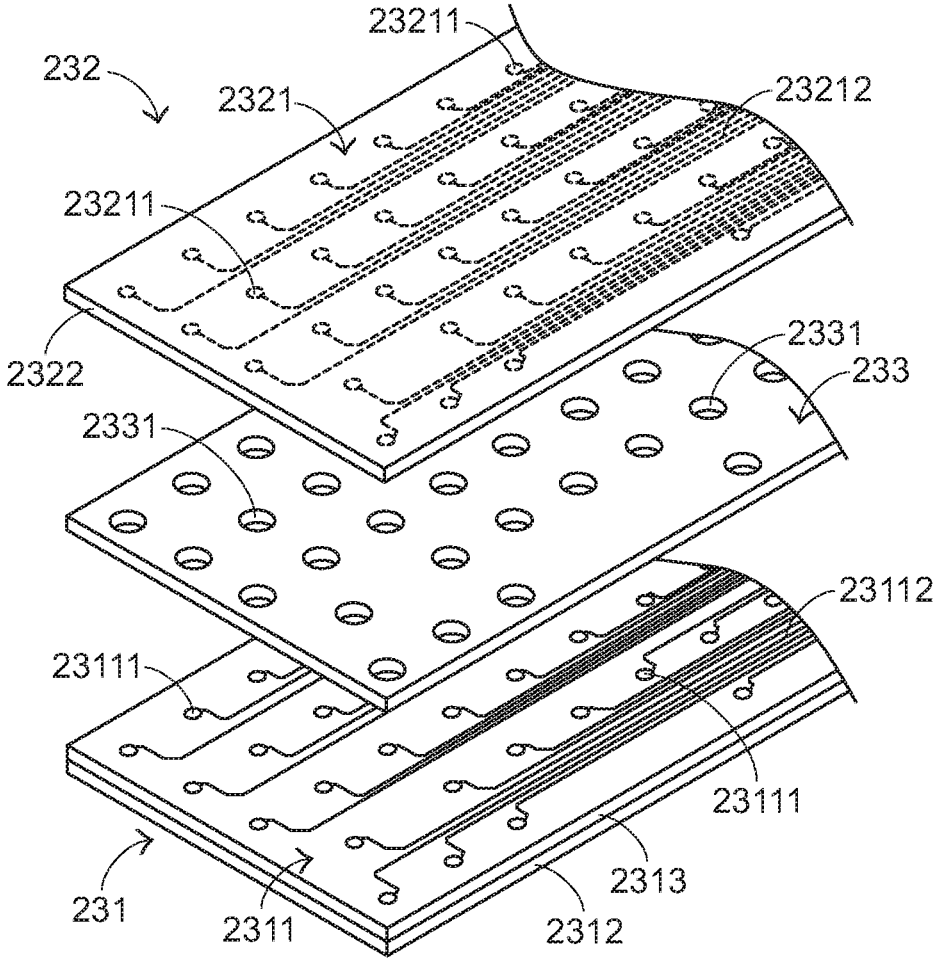
FIG. 6 is a schematic exploded view illustrating a membrane circuit board of the luminous keyboard of FIG. 5.

FIG. 6 is a schematic exploded view illustrating a membrane circuit board of the luminous keyboard of FIG. 5. The membrane circuit member 23 comprises a lower wiring board 231 and an upper wiring board 232. A first circuit pattern 2311 is formed on a top surface of the lower wiring board 231. In addition, the first circuit pattern 2311 comprises plural lower contacts 23111. The upper wiring board 232 comprises an upper film layer 2322 and a second circuit pattern 2321. The second circuit pattern 2321 is formed on a bottom surface of the upper film layer 2322. The second circuit pattern 2321 comprises plural upper contacts 23211 corresponding to the plural lower contacts 23111. Each of the upper contacts 23211 and the corresponding lower contact 23111 are separated from each other by a spacing interval D. Moreover, each of the upper contacts 23211 and the corresponding lower contact 23111 are collectively defined as a membrane switch 234. Moreover, for maintaining the spacing interval D between each upper contact 23211 and the corresponding lower contact 23111, the membrane circuit member 23 further comprises an intermediate board 233. The intermediate board 233 is arranged between the lower wiring board 231 and the upper wiring board 232. In addition, the intermediate board 233 has plural perforations 2331 corresponding to the plural lower contacts 23111 and the plural upper contacts 23211.

Please refer to FIG. 5 again. The key base plate 29 is used for connecting the plural keys 24. The key base plate 29 has plural openings 291 corresponding to the plural keys 24. In addition, the plural keys 24 are aligned with corresponding membrane switches 234. Each of the keys 24 comprises a keycap 241 and a connecting element 243. The connecting element 243 is arranged between the key base plate 29 and the keycap 241 for connecting the key base plate 29 and the keycap 241, so that the keycap 241 is movable upwardly and downwardly relative to the key base plate 29.

In this embodiment, the connecting element 243 is a scissors-type connecting element including a first frame 2431 and a second frame 2432. In addition, the key base plate 29 further comprises a first fixing structure 292 and a second fixing structure 293, and each of the plural keys 24 further comprises an elastic element 242. The elastic element 242 is arranged between the keycap 241 and the key base plate 29. The elastic element 242 has a sustaining part 2421. Moreover, the keycap 241 of each key 24 comprises a first keycap fixing structure 2411 and a second keycap fixing structure 2412.

A first end 2431A of the first frame 2431 is connected to the second fixing structure 293, and a second end 2431B of the first frame 2431 is connected to the first keycap fixing structure 2411. In addition, a second end 2432A of the second frame 2432 is connected to the first fixing structure 292, and a second end 2432B of the second frame 2432 is connected to the second keycap fixing structure 2412. The relationship between the connecting element 243, the key base plate 29 and the keycap 241 is presented herein for purpose of illustration and description only. It is noted that the relationship between the connecting element 243, the key base plate 29 and the keycap 241 is not restricted.

When any key 24 is depressed and moved downwardly relative to the key base plate 29, the first frame 2431 and the second frame 2432 of the connecting element 243 are switched from an open-scissors state to a folded state. Moreover, as the keycap 241 is moved downwardly to compress the elastic element 242, the sustaining part 2421 of the elastic element 242 is penetrated through the opening 291 of the key base plate 29 and sustained against a corresponding upper contact 23211. Consequently, the upper contact 23211 is inserted into a corresponding perforation 2331 to touch the corresponding lower contact 23111. In such way, the corresponding membrane switch 234 is electrically conducted, and the luminous keyboard 2 generates a corresponding key signal. Whereas, when the depressing force exerted on the key 24 is eliminated, an elastic force provided by the elastic element 242 is acted on the keycap 241. Due to the elastic force, the keycap 241 is moved upwardly relative to the key base plate 29. Meanwhile, the first frame 2431 and the second frame 2432 of the scissors-type connecting element 243 are switched from the folded state to the open-scissors state, and the keycap 241 is returned to its original position.

Figure 7:
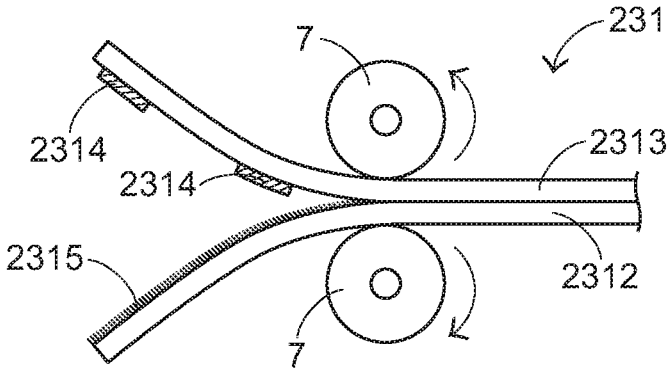
FIG. 7 is a schematic side view illustrating a process of forming the lower wiring board of the membrane circuit member of the luminous keyboard according to the first embodiment of the present invention.

In accordance with a feature of the present invention, the lower wiring board 231 of the membrane circuit member 23 of the luminous keyboard 2 has a multilayered film configuration. FIG. 7 is a schematic side view illustrating a process of forming the lower wiring board of the membrane circuit member of the luminous keyboard according to the first embodiment of the present invention. In the first embodiment, the lower wiring board 231 comprises a first film layer 2313 and a second film layer 2312, wherein the first film layer 2313 is attached on a top surface of the second film layer 2312. In addition, plural light-guiding dots 2314 are arranged between the first film layer 2313 and the second film layer 2312 for collecting and scattering the light beams from the light-emitting element 21. The locations of the plural light-guiding dots 2314 are determined according to the locations of the plural keys 24. By the plural light-guiding dots 2314, the light beams are projected upwardly toward the plural keys 24. The first film layer 2313 and the second film layer 2312 are made of a light-guiding material. The light-guiding material includes for example polycarbonate (PC) or polyethylene terephthalate (PET). The first circuit pattern 2311 is printed on the top surface of the first film layer 2313 of the lower wiring board 231. Moreover, the plural light-guiding dots 2314 are formed on one of the first film layer and the second film layer by a screen printing process, a thermal compression process or an injection process.

A process of fabricating the lower wiring board 231 will be illustrated as follows. Firstly, plural light-guiding dots 2314 are formed on the bottom surface of the first film layer 2313, and a light-transmissible transparent adhesive 2315 is coated on the top surface of the second film layer 2312. Alternatively, plural light-guiding dots 2314 are formed on the top surface of the second film layer 2312, and a light-transmissible transparent adhesive 2315 is coated on the bottom surface of the first film layer 2313. Then, the first film layer 2313 and the second film layer 2312 are hot-pressed or cold-pressed by two rollers 7, so that the first film layer 2313 and the second film layer 2312 are combined together through the transparent adhesive 2315.

Figure 8:
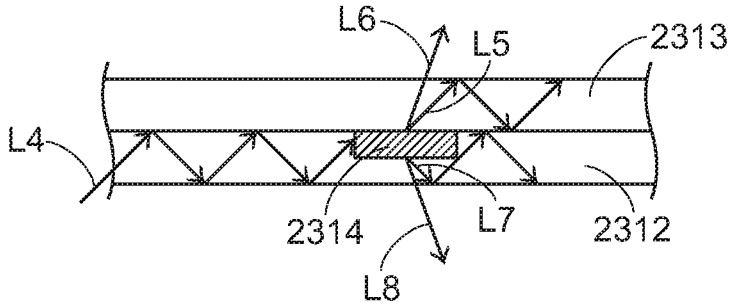
FIG. 8 schematically illustrates a light path in the lower wiring board of FIG. 7.

FIG. 8 schematically illustrates a light path in the lower wiring board of FIG. 7. Please refer to FIGS. 5 and 8. After the light beams from the light-emitting element 21 are incident into the lower wiring board 231, the light beams L4 can be diffused within the second film layer 2312 and the first film layer 2313. When the light beams hit the light-guiding dots 2314, the light beams will be partially collected by the light-guiding dots 2314 and partially scattered upwardly or downwardly. A portion of the light beams that are scattered upwardly (i.e. L5) will be transferred within the first film layer 2313. Another portion of the light beams that are scattered upwardly (i.e. L6) will be sequentially transmitted through the first film layer 2313 and the corresponding opening 291 of the key base plate 29 and directed upwardly to the keys 24, thereby illuminating the plural keys 24. A portion of the light beams that are scattered downwardly (i.e. L7) will be transferred within the second film layer 2312. Another portion of the light beams that are scattered downwardly (i.e. L8) will be transmitted through the second film layer 2312 and lost.

The benefits of the lower wiring board 231 of the first embodiment will be illustrated as follows. Since the plural light-guiding dots 2314 are arranged between the first film layer 2313 and the second film layer 2312, the portion of the light beams that are scattered downwardly (i.e. L7) by the light-guiding dots 2314 and continuously transferred within the second film layer 2312 will be recycled. That is, only the portion of the light beams that are scattered downwardly (i.e. L8) and transmitted through the second film layer 2312 are lost. In a case that only the first film layer 2313 and the plural light-guiding dots 2314 are included in the lower wiring board 231 but the second film layer 2312 is excluded, the portion of the light beams that are scattered downwardly will be completely lost.

Figure 9:
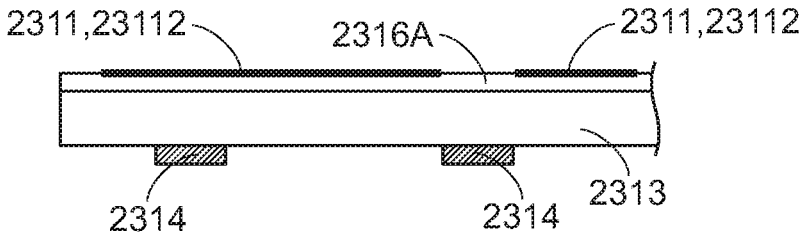
FIG. 9 is a schematic side view illustrating the lower wiring board of the membrane circuit member of the luminous keyboard according to a second embodiment of the present invention.
Figure 10:
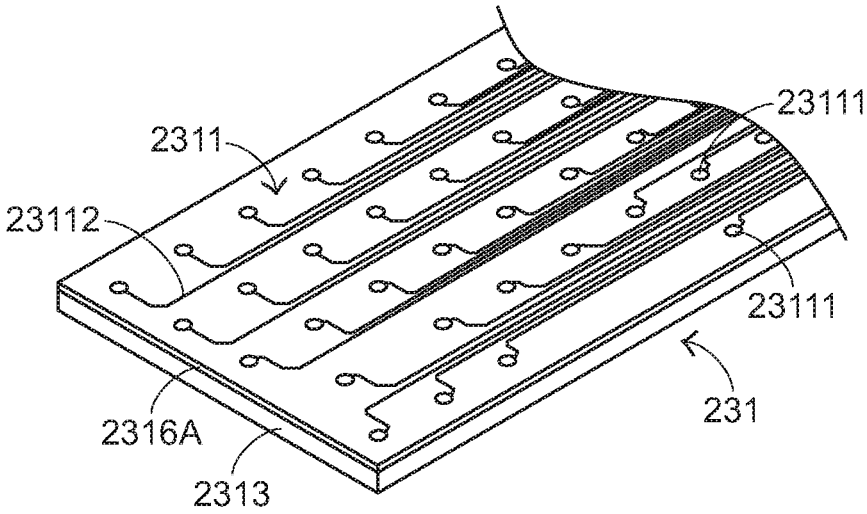
FIG. 10 is a schematic perspective view illustrating the lower wiring board of FIG. 9.

The present invention also provides a luminous keyboard of a second embodiment. Except for the configurations of the lower wiring board of the membrane circuit member, the configurations of the luminous keyboard of the second embodiment are substantially identical to those of the luminous keyboard of the first embodiment. Please refer to FIGS. 9 and 10. FIG. 9 is a schematic side view illustrating the lower wiring board of the membrane circuit member of the luminous keyboard according to a second embodiment of the present invention. FIG. 10 is a schematic perspective view illustrating the lower wiring board of FIG. 9.

In this embodiment, the lower wiring board 231 comprises a first film layer 2313 and a spacer film layer 2316A. The spacer film layer 2316A is formed on a top surface of the first film layer 2313. In addition, plural light-guiding dots 2314 are formed on a bottom surface of the first film layer 2313. The locations of the plural light-guiding dots 2314 are determined according to the locations of the plural keys 24. By the plural light-guiding dots 2314, the light beams are projected upwardly toward the plural keys 24. The first circuit pattern 2311 is printed on the top surface of the spacer film layer 2316A. The first circuit pattern 2311 comprises plural lower contacts 23111 and plural metallic conductor lines 23112. The plural metallic conductor lines 23112 have functions of collecting and scattering the light beams. In this embodiment, the plural metallic conductor lines 23112 are silver paste conductor lines because of the high electrical conductivity. In addition, the spacer film layer 2316A is a single continuous film layer, and the plural metallic conductor lines 23112 are formed on the single continuous film layer.

Moreover, during the process of forming the lower wiring board 231, the spacer film layer 2316A is formed on the surface of the first film layer 2313 by a printing process, a film deposition process, a gluing process or a thermal compression process. In this embodiment, the first film layer 2313 is made of a light-guiding material. An example of the light-guiding material includes but is not limited to polycarbonate (PC), polyethylene terephthalate (PET) or polymethylmethacrylate (PMMA). Whereas, the spacer film layer 2316A is made of a material different from the first film layer 2313.

Figure 11:
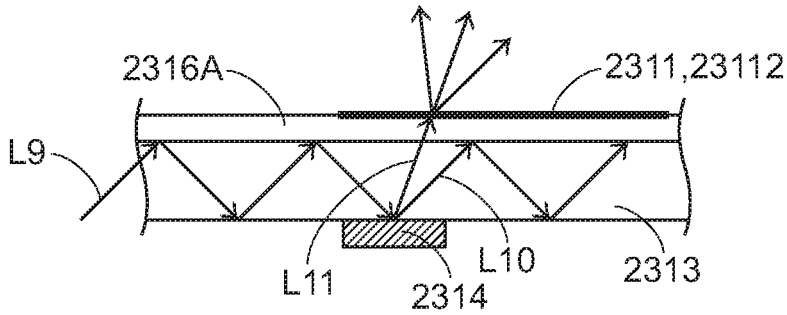
FIG. 11 schematically illustrates a light path in the lower wiring board of FIG. 9.

FIG. 11 schematically illustrates a light path in the lower wiring board of FIG. 9. After the light beams from the light-emitting element 21 are incident into the lower wiring board 231, the light beams L9 can be diffused within the first film layer 2313. When the light beams L9 hit the light-guiding dots 2314, the light beams will be partially collected by the light-guiding dots 2314 and partially scattered upwardly or downwardly. A portion of the light beams that are scattered upwardly (i.e. L10) will be transferred within the first film layer 2313. Another portion of the light beams that are scattered upwardly (i.e. L11) will be transmitted through the first film layer 2313.

In the second embodiment, the spacer film layer 2316A is arranged between the first circuit pattern 2311 and the first film layer 2313. In addition, the spacer film layer 2316A is made of a material different from the first film layer 2313. That is, the refractive index of the spacer film layer 2316A is lower than the refractive index of the first film layer 2313. Consequently, the light beams transferred through the first film layer 2313 (e.g. along the light paths of the light beams L9 and the light beams L10) are readily subject to total internal reflection. Under this circumstance, after the light beams are transmitted through the first film layer 2313 (i.e. along the light path of the light beams L11), the percentage of the light beams to be collected and scattered by the metallic conductor lines 23112 of the first circuit pattern 2311 will be largely reduced. Consequently, the amount of light beams to be scattered upwardly by the light-guiding dots 2314 of the lower wiring board 231 will be increased, and the keys 24 of the luminous keyboard 2 are illuminated by more light beams. It is noted that the plural light-guiding dots 2314 are not essential components to limit the scopes of the above embodiments.

Figure 12:
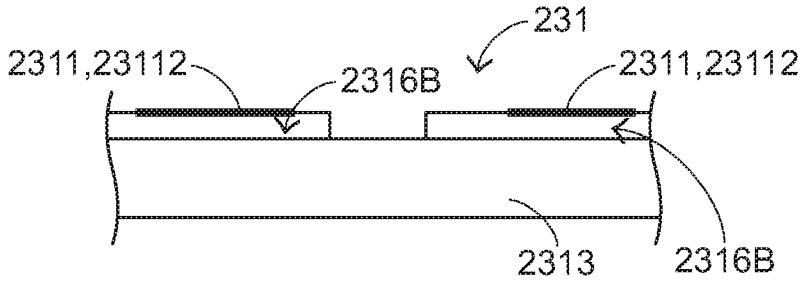
FIG. 12 is a schematic side view illustrating the lower wiring board of the membrane circuit member of the luminous keyboard according to a third embodiment of the present invention.
Figure 13:
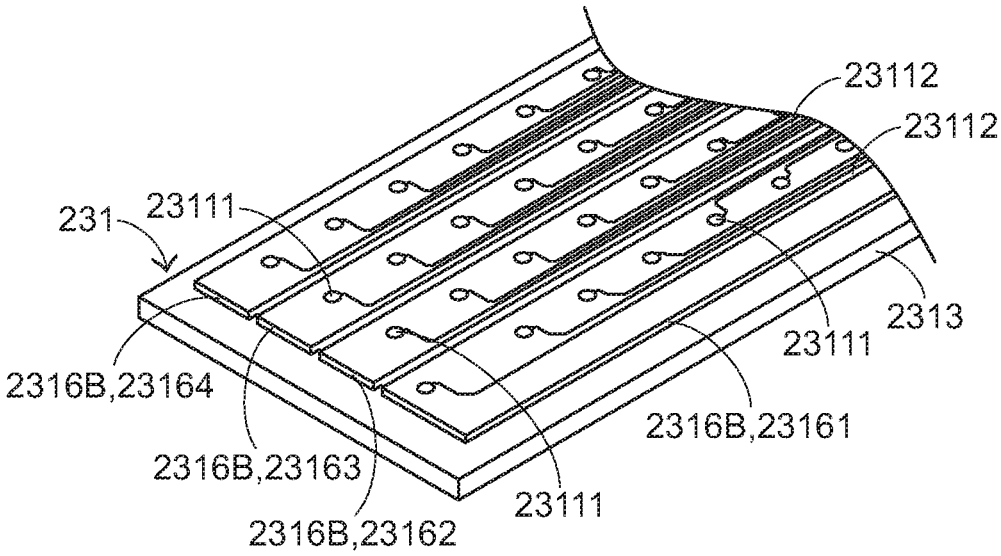
FIG. 13 is a schematic perspective view illustrating the lower wiring board of FIG. 12.

The present invention also provides a luminous keyboard of a third embodiment. In comparison with the luminous keyboard of the second embodiment, the spacer film layer of the lower wiring board of the luminous keyboard of the third embodiment is distinguished and no light-guiding dots are formed on the lower wiring board. Please refer to FIGS. 12 and 13. FIG. 12 is a schematic side view illustrating the lower wiring board of the membrane circuit member of the luminous keyboard according to a third embodiment of the present invention. FIG. 13 is a schematic perspective view illustrating the lower wiring board of FIG. 12.

In this embodiment, the spacer film layer 2316B of the lower wiring board 231 comprises plural separate block-type film layers 23161, 23162, 23163 and 23164. The plural metallic conductor lines 23112 are formed on the block-type film layers 23161, 23162, 23163 and 23164, respectively. Similarly, the refractive index of each of the block-type film layers 23161, 23162, 23163 and 23164 is lower than the refractive index of the first film layer 2313. However, those skilled in the art will readily observe that numerous modifications and alterations may be made while retaining the teachings of the invention. For example, some of the metallic conductor lines 23112 are formed across and on any two of these block-type film layers 23161, 23162, 23163 and 23164.

Figure 14:
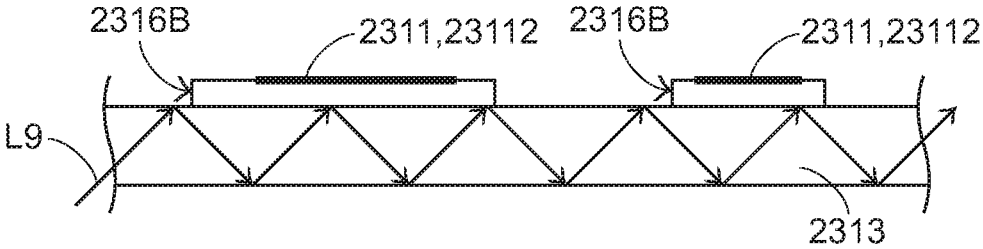
FIG. 14 schematically illustrates a light path in the lower wiring board of FIG. 12.

FIG. 14 schematically illustrates a light path in the lower wiring board of FIG. 12. As known, since the refractive index of air is 1, nearly none of the current optical media has refractive index higher than air according to the state-of-the-art technology. Consequently, when the light beams L9 are laterally incident into the lower wiring board 231, the regions of the first film layer 2313 uncovered by the spacer film layer 2316B are the optimal places that are subject to total internal reflection. In other words, the efficacy of the total internal reflection of the light beams L9 in the first film layer 2313 of this embodiment is better than that of the second embodiment. Consequently, the light beams provided to the lower wiring board 231 can be diffused to the whole first film layer 2313 more uniformly.

The present invention also provides a luminous keyboard of a fourth embodiment. Except for the configurations of the lower wiring board 231 of the membrane circuit member 23, the configurations of the luminous keyboard of the second embodiment are substantially identical to those of the luminous keyboards of the first embodiment and the second embodiment. In this embodiment, the lower wiring board 231 is a combination of the lower wiring board of the first embodiment and the lower wiring board of the second embodiment. Please refer to FIG. 15, which is a schematic side view illustrating the lower wiring board of the membrane circuit member of the luminous keyboard according to a fourth embodiment of the present invention.

Figure 15:
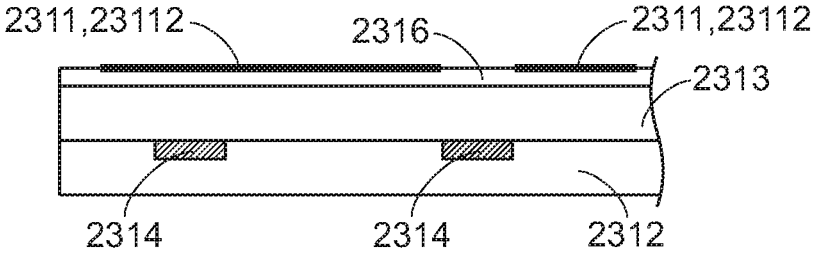
FIG. 15 is a schematic side view illustrating the lower wiring board of the membrane circuit member of the luminous keyboard according to a fourth embodiment of the present invention.

Please refer to FIGS. 5 and 15. In this embodiment, the lower wiring board 231 comprises a first film layer 2313, a second film layer 2312, and a spacer film layer 2316. The first film layer 2313 is adhered on a top surface of the second film layer 2312. The spacer film layer 2316 is formed on a top surface of the first film layer 2313. In addition, plural light-guiding dots 2314 are arranged between the first film layer 2313 and the second film layer 2312 for collecting and scattering the light beams from the light-emitting element 21. The locations of the plural light-guiding dots 2314 are determined according to the locations of the plural keys 24. By the plural light-guiding dots 2314, the light beams are projected upwardly. Then, the light beams are transmitted through the openings 291 of the key base plate 29 and directed to the plural keys 24.

The first circuit pattern 2311 is printed on the top surface of the spacer film layer 2316. The first circuit pattern 2311 comprises plural metallic conductor lines 23112. The plural metallic conductor lines 23112 have functions of collecting and scattering the light beams. In other words, the lower wiring board 231 of the fourth embodiment has the combined benefits of the first embodiment and the second embodiment. Moreover, the material and fabricating process of the lower wiring board 231 of the fourth embodiment are similar to those of the lower wiring board of the second embodiment, and are not redundantly described herein. It is noted that the plural light-guiding dots 2314 are not essential components to limit the scopes of the above embodiments. However, those skilled in the art will readily observe that numerous modifications and alterations may be made while retaining the teachings of the fourth embodiment. For example, the lower wiring board may be designed to have the combined structure of the first embodiment and the third embodiment.

Figure 16:
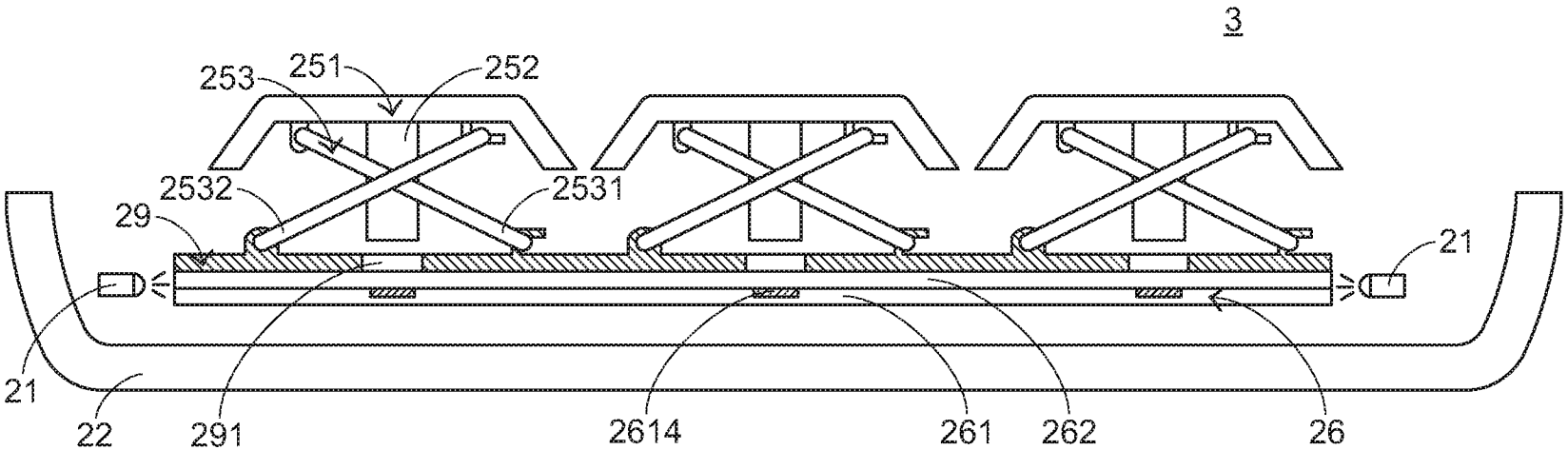
FIG. 16 is a schematic cross-sectional view illustrating a luminous keyboard according to a fifth embodiment of the present invention.
Figure 17:
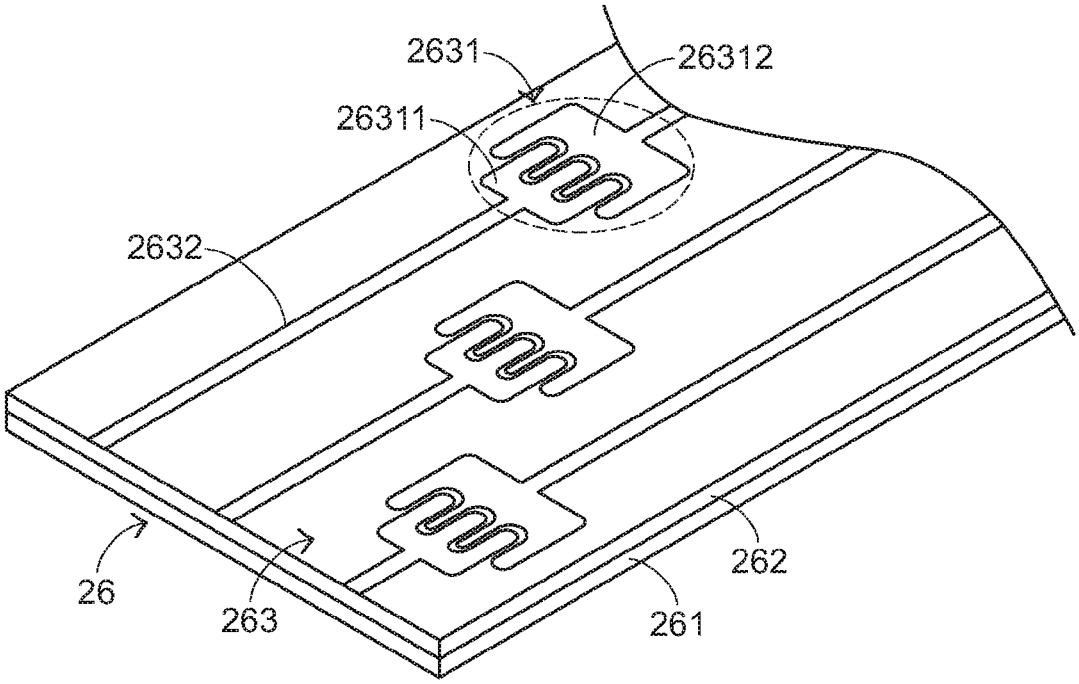
FIG. 17 is a schematic perspective view illustrating the membrane circuit member of the luminous keyboard according to the fifth embodiment of the present invention.

The present invention also provides a luminous keyboard of a fifth embodiment. FIG. 16 is a schematic cross-sectional view illustrating a luminous keyboard according to a fifth embodiment of the present invention. FIG. 17 is a schematic perspective view illustrating the membrane circuit member of the luminous keyboard according to the fifth embodiment of the present invention. Except for the following items, the configurations of the luminous keyboard 3 of the fifth embodiment are identical to those of first embodiment. For example, the membrane circuit member 26 is a single board. A circuit pattern 263 is formed on the top surface of the membrane circuit member 26. The circuit pattern 263 comprises plural membrane switches 2631 and plural metallic conductor lines 2632. Each of the membrane switches 2631 comprises a first conductive part 26311 and a second conductive part 26312. The first conductive part 26311 is separated from the second conductive part 26312.

Moreover, each key 25 further comprises a key conductor 252. The key conductor 252 is connected with the keycap 251. The key conductor 252 is arranged between the keycap 251 and the key base plate 29. When the keycap 251 is depressed and moved downwardly relative to the key base plate 29, the first frame 2531 and the second frame 2532 of the connecting element 253 are switched from an open-scissors state to a folded state. In addition, the key conductor 252 is penetrated through the corresponding opening 291 of the key base plate 29 to be in contact with the corresponding membrane switch 2631. In such way, the membrane switch 2631 is electrically conducted, and the luminous keyboard 3 generates a corresponding key signal.

In this embodiment, the membrane circuit member 26 also has a multilayered film configuration. The membrane circuit member 26 comprises a first film layer 262 and the second film layer 261, which are similar to the first film layer 2313 and the second film layer 2312 of the first embodiment. In addition, plural light-guiding dots 2614 are arranged between the first film layer 262 and the second film layer 261 for collecting and scattering the light beams from the light-emitting element 21. In other words, the membrane circuit member 26 of this embodiment has benefits similar to the lower wiring board 231 of the first embodiment.

It is noted that numerous modifications and alterations may be made while retaining the teachings of the invention. The present invention also provides a luminous keyboard of a sixth embodiment. In the sixth embodiment, the membrane circuit member 26 of the luminous keyboard 3 as shown in the fifth embodiment may be arranged in a stacked-film configuration as shown in the second embodiment. That is, the membrane circuit member 26 comprises a first film layer 262 and a spacer film layer (not shown). The spacer film layer is formed on a top surface of the first film layer 262. In addition, plural light-guiding dots 2614 are formed on a bottom surface of the first film layer 262. In other words, the membrane circuit member 26 of this embodiment has benefits similar to the lower wiring board 231 of the second embodiment.

The present invention also provides a luminous keyboard of a seventh embodiment. In the seventh embodiment, the membrane circuit member 26 of the luminous keyboard 3 as shown in the fifth embodiment may be arranged in a stacked-film configuration as shown in the third embodiment. That is, the membrane circuit member 26 comprises a first film layer 262 and a spacer film layer (not shown). The spacer film layer is formed on a top surface of the first film layer 262. In addition, the spacer film layer comprises plural separate block-type film layers. In other words, the membrane circuit member 26 of this embodiment has benefits similar to the lower wiring board 231 of the third embodiment.

The present invention also provides a luminous keyboard of an eighth embodiment. In the seventh embodiment, the membrane circuit member 26 of the luminous keyboard 3 as shown in the fifth embodiment may be arranged in a stacked-film configuration as shown in the fourth embodiment. That is, the membrane circuit member 26 comprises a first film layer 261, a second film layer 262, and a spacer film layer (not shown). The first film layer 262 is adhered on a top surface of the second film layer 261. The spacer film layer is formed on a top surface of the first film layer 262. In addition, plural light-guiding dots 2614 are arranged between the first film layer 262 and the second film layer 261 for collecting and scattering the light beams from the light-emitting element 21. In other words, the membrane circuit member 26 of this embodiment has benefits similar to the lower wiring board 231 of the fourth embodiment.

In the above embodiments, the light guide plate used in the conventional luminous keyboard is exempted from the luminous keyboard 2, 3 of the present invention. Consequently, the fabricating cost is reduced. Moreover, since the membrane circuit member 23, 26 or the lower wiring board 231 of the luminous keyboard 2, 3 has the multilayered film configuration, the percentage of the light beams to be collected by the metallic conductor lines 2632 of the circuit pattern 263 or the metallic conductor lines 23112 of the first circuit pattern 2311 will be largely reduced. Consequently, the amount of light beams to illuminate the keys 24 or 25 will be increased, and the light beams that are scattered downwardly by the light-guiding dots 2614 or 2314 will be further recycled. Under this circumstance, the keys 24 or 25 of the luminous keyboard 2 or 3 are illuminated by more light beams. In other words, the light beams provided by the light-emitting element 21 are efficiently utilized to illuminate the luminous keyboard 2, 3.

In accordance with another feature of the present invention, the key base plate 29 is arranged between the plural keys 24, 25 and the membrane circuit member 23, 26. Consequently, even if the apertures used in the membrane circuit member of the conventional luminous keyboard are exempted from the membrane circuit member 23, 26, the connecting element 243, 253 can be used to connect the key base plate 29 and the corresponding keycap 241, 251. Since no apertures are included in the membrane circuit member 23, 26, the light-guiding function of the lower membrane circuit member 23, 26 can be continuously performed. That is, the light beams provided by the light-emitting element 21 are no longer interrupted at the regions corresponding to the apertures. Under this circumstance, the illuminating efficacy of the luminous keyboard 2, 3 of the present invention will be largely enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A luminous keyboard, comprising:

at least one light-emitting element for providing light beams to illuminate said luminous keyboard;

a membrane circuit member comprising:

a lower wiring board comprising a first circuit pattern and plural light-guiding dots, wherein said first circuit pattern comprises plural lower contacts, and said light beams from said light-emitting element are collected and scattered by said plural light-guiding dots, wherein said lower wiring board further comprises a first film layer and a second film layer for increasing an amount of said light beams which are scattered upwardly by said plural light-guiding dots, wherein said first film layer is a light-guiding film layer, and said second film layer is a spacer film layer, wherein said spacer film layer is arranged between said light-guiding film layer and said first circuit pattern for increasing possibility of resulting in total internal reflection when said light beams are incident into said light-guiding film layer; and an upper wiring board comprising a second circuit pattern, wherein said second circuit pattern comprises plural upper contacts corresponding to said plural lower contacts, wherein each of said upper contacts and said corresponding lower contact are separated from each other by a spacing interval, and each of said upper contacts and said corresponding lower contact are collectively defined as a membrane switch;

plural keys aligned with said plural membrane switches for conducting corresponding membrane switches; and a key base plate for connecting said plural keys, wherein said key base plate has plural openings corresponding to respective keys, wherein said key base plate is arranged between said plural keys and said membrane circuit member.

2. The luminous keyboard according to claim 1, wherein each of said first film layer and said second film layer is a light-guiding film layer.

3. The luminous keyboard according to claim 2, wherein said plural light-guiding dots are arranged between said first film layer and said second film layer.

4. The luminous keyboard according to claim 3, wherein said plural light-guiding dots are formed on one of said first film layer and said second film layer by a screen printing process, a thermal compression process or an injection process.

5. The luminous keyboard according to claim 3, wherein said lower wiring board further comprises a spacer film layer, which is arranged between said first film layer and said first circuit pattern for increasing possibility of resulting in total internal reflection when said light beams are incident into said first film layer.

6. The luminous keyboard according to claim 5, wherein said spacer film layer is formed on said first film layer by a printing process, a film deposition process, a gluing process or a thermal compression process.

7. The luminous keyboard according to claim 2, further comprising a light-transmissible transparent adhesive, wherein said light-transmissible transparent adhesive is arranged between said first film layer and said second film layer, so that said first film layer and said second film layer are combined together through said light-transmissible transparent adhesive.

8. The luminous keyboard according to claim 2, wherein said light-guiding film layer is made of polyethylene terephthalate (PET), polycarbonate (PC) or polymethylmethacrylate (PMMA).

9. The luminous keyboard according to claim 1, wherein said plural light-guiding dots are formed on a bottom surface of said light-guiding film layer.

10. The luminous keyboard according to claim 1, wherein said spacer film layer is formed on said light-guiding film layer by a printing process, a film deposition process, a gluing process or a thermal compression process.

11. The luminous keyboard according to claim 1, wherein said light-emitting element is a light emitting diode, which is located beside said membrane circuit member for providing said light beams to said membrane circuit member.

12. The luminous keyboard according to claim 1, further comprising a keyboard base, which is disposed under said membrane circuit member for supporting said plural keys, said key base plate, said membrane circuit member and said light-emitting element.

13. The luminous keyboard according to claim 1, wherein each of said plural keys comprises:

a keycap exposed outside said luminous keyboard; and a connecting element arranged between said key base plate and said keycap for connecting said key base plate and said keycap, so that said keycap is movable upwardly or downwardly relative to said key base plate.

14. The luminous keyboard according to claim 13, wherein each of said plural keys comprises an elastic element, wherein said elastic element is arranged between said keycap and said key base plate, and comprises a sustaining part, wherein said connecting element is a scissors-type connecting element, wherein when said keycap is depressed, said elastic element is compressed and said sustaining part is penetrated through a corresponding opening of said key base plate to push against a corresponding membrane switch, wherein when a depressing force exerted on said keycap is eliminated, an elastic force provided by said elastic element is acted on said keycap, so that said keycap is returned to an original position.

15. The luminous keyboard according to claim 1, wherein said membrane circuit member further comprises an intermediate board, which is arranged between said upper wiring board and said lower wiring board, so that each of said upper contacts and said corresponding lower contact are separated from each other by said spacing interval, wherein said intermediate board has plural perforations corresponding to said plural lower contacts and said plural upper contacts.

16. A luminous keyboard, comprising:

at least one light-emitting element for providing light beams to illuminate said luminous keyboard;

a membrane circuit member comprising a circuit pattern and plural light-guiding dots, wherein said circuit pattern comprises plural membrane switches, and said light beams from said light-emitting element are collected and scattered by said plural light-guiding dots, wherein said membrane circuit member further comprises a first film layer and a second film layer for increasing an amount of said light beams which are scattered upwardly by said plural light-guiding dots, wherein said first film layer is a light-guiding film layer, and said second film layer is a spacer film layer, wherein said spacer film layer is arranged between said light-guiding film layer and said circuit pattern for increasing possibility of resulting in total internal reflection when said light beams are incident into said light-guiding film layer;

plural keys aligned with said plural membrane switches for conducting corresponding membrane switches; and a key base plate for connecting said plural keys, wherein said key base plate has plural openings corresponding to respective keys, wherein said key base plate is arranged between said plural keys and said membrane circuit member.

17. The luminous keyboard according to claim 16, wherein each of said membrane switches comprises a first conductive part and a second conductive part, wherein said first conductive part is separated from said second conductive part.

18. The luminous keyboard according to claim 17, wherein each of said plural keys comprises:

a keycap exposed outside said luminous keyboard; and a connecting element arranged between said key base plate and said keycap for connecting said key base plate and said keycap, so that said keycap is movable upwardly or downwardly relative to said key base plate; and a key conductor arranged between said keycap and said key base plate, wherein when said keycap is depressed, said key conductor is penetrated through a corresponding opening of said key base plate to push against a corresponding membrane switch, so that said corresponding membrane switch is conducted.

19. The luminous keyboard according to claim 18, wherein said connecting element is a scissors-type connecting element.

20. The luminous keyboard according to claim 16, wherein each of said first film layer and said second film layer is a light-guiding film layer.

21. The luminous keyboard according to claim 20, wherein said plural light-guiding dots are arranged between said first film layer and said second film layer.

22. The luminous keyboard according to claim 21, wherein said plural light-guiding dots are formed on one of said first film layer and said second film layer by a screen printing process, a thermal compression process or an injection process.

23. The luminous keyboard according to claim 21, wherein said lower wiring board further comprises a spacer film layer, which is arranged between said first film layer and said circuit pattern for increasing possibility of resulting in total internal reflection when said light beams are incident into said first film layer.

24. The luminous keyboard according to claim 23, wherein said spacer film layer is formed on said first film layer by a printing process, a film deposition process, a gluing process or a thermal compression process.

25. The luminous keyboard according to claim 21, further comprising a light-transmissible transparent adhesive, wherein said light-transmissible transparent adhesive is arranged between said first film layer and said second film layer, so that said first film layer and said second film layer are combined together through said light-transmissible transparent adhesive.

26. The luminous keyboard according to claim 20, wherein said light-guiding film layer is made of polyethylene terephthalate (PET), polycarbonate (PC) or polymethylmethacrylate (PMMA).

27. The luminous keyboard according to claim 16, wherein said plural light-guiding dots are formed on a bottom surface of said light-guiding film layer.

28. The luminous keyboard according to claim 16, wherein said spacer film layer is formed on said light-guiding film layer by a printing process, a film deposition process, a gluing process or a thermal compression process.

29. The luminous keyboard according to claim 16, wherein said light-emitting element is a light emitting diode, which is located beside said membrane circuit member for providing said light beams to said membrane circuit member.

30. The luminous keyboard according to claim 16, further comprising a keyboard base, which is disposed under said membrane circuit member for supporting said plural keys, said key base plate, said membrane circuit member and said light-emitting element.

31. A luminous keyboard, comprising:

at least one light-emitting element for providing light beams to illuminate said luminous keyboard;

a membrane circuit member comprising:

an upper wiring board comprising an upper film layer and a second circuit pattern formed on a bottom surface of said upper film layer, wherein said second circuit pattern has plural upper contacts;

a lower wiring board comprising a first film layer, a first circuit pattern, and a second film layer arranged between said first film layer and said first circuit pattern, wherein said first circuit pattern comprises plural lower contacts corresponding to said plural upper contacts, each of said upper contacts and said corresponding lower contact are separated from each other by a spacing interval, and each of said upper contacts and said corresponding lower contact are collectively defined as a membrane switch, wherein a refractive index of said second film layer is lower than a refractive index of said first film layer, wherein said first circuit pattern further comprises plural metallic conductor lines, and wherein said second film layer is a single continuous film layer, and said metallic conductor lines are formed on said single continuous film layer;

plural keys aligned with said plural membrane switches for conducting corresponding membrane switches; and a key base plate for connecting said plural keys, wherein said key base plate has plural openings corresponding to respective keys, wherein said key base plate is arranged between said plural keys and said membrane circuit member.

32. The luminous keyboard according to claim 31, wherein said metallic conductor lines are silver paste conductor lines.

33. The luminous keyboard according to claim 31, wherein said second film layer is formed on said first film layer by a printing process, a film deposition process, a gluing process or a thermal compression process.

34. The luminous keyboard according to claim 31, wherein said second film layer comprises plural separate block-type film layers, and said plural metallic conductor lines are formed on said plural block-type film layers.

35. The luminous keyboard according to claim 34, wherein said plural block-type film layers are formed on said first film layer by a printing process, a film deposition process, a gluing process or a thermal compression process.

36. The luminous keyboard according to claim 31, wherein said first film layer is a light-guiding film layer.

37. The luminous keyboard according to claim 36, wherein said light-guiding film layer is made of polyethylene terephthalate (PET), polycarbonate (PC) or polymethylmethacrylate (PMMA).

38. The luminous keyboard according to claim 31, wherein said light-emitting element is a light emitting diode, which is located beside said membrane circuit member for providing said light beams to said membrane circuit member.

39. The luminous keyboard according to claim 31, further comprising a keyboard base, which is disposed under said membrane circuit member for supporting said plural keys, said key base plate, said membrane circuit member and said light-emitting element.

40. The luminous keyboard according to claim 31, wherein each of said plural keys comprises:

a keycap exposed outside said luminous keyboard; and a connecting element arranged between said key base plate and said keycap for connecting said key base plate and said keycap, so that said keycap is movable upwardly or downwardly relative to said key base plate.

41. The luminous keyboard according to claim 40, wherein each of said plural keys comprises an elastic element, wherein said elastic element is arranged between said keycap and said key base plate, and comprises a sustaining part, wherein said connecting element is a scissors-type connecting element, wherein when said keycap is depressed, said elastic element is compressed and said sustaining part is penetrated through a corresponding opening of said key base plate to push against a corresponding membrane switch, wherein when a depressing force exerted on said keycap is eliminated, an elastic force provided by said elastic element is acted on said keycap, so that said keycap is returned to an original position.

42. The luminous keyboard according to claim 31, wherein said membrane circuit member further comprises an intermediate board, which is arranged between said upper wiring board and said lower wiring board, so that each of said upper contacts and said corresponding lower contact are separated from each other by said spacing interval, wherein said intermediate board has plural perforations corresponding to said plural lower contacts and said plural upper contacts.

* * * * *